US012650236B2

(12) United States Patent
Brasuell et al.

(10) Patent No.: US 12,650,236 B2
(45) Date of Patent: Jun. 9, 2026

(54) ADJUSTABLE SPLIT HEATING, VENTILATING, AND AIR CONDITIONING SYSTEMS

(71) Applicant: Rheem Manufacturing Company, Atlanta, GA (US)

(72) Inventors: Derek Brasuell, Van Buren, AR (US); Mark Creason, Hackett, AR (US); Robert Neihouse, Fort Smith, AR (US); Sachin Nehete, Forth Smith, AR (US); Tyler Foust, Fort Smith, AR (US); Christopher Puranen, Atlanta, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 236 days.

(21) Appl. No.: 18/402,209

(22) Filed: Jan. 2, 2024

(65) Prior Publication Data

US 2024/0240822 A1 Jul. 18, 2024

Related U.S. Application Data

(60) Provisional application No. 63/479,567, filed on Jan. 12, 2023.

(51) Int. Cl.

| | |
|---|---|
| ***F24F 11/49*** | (2018.01) |
| ***F24F 1/0003*** | (2019.01) |
| ***F24F 11/84*** | (2018.01) |
| ***F24F 11/86*** | (2018.01) |
| *F24F 110/10* | (2018.01) |
| *F24F 110/20* | (2018.01) |
| *F24F 140/12* | (2018.01) |

(Continued)

(52) U.S. Cl.
CPC ..... *F24F 11/49* (2018.01); *F24F 1/0003* (2013.01); *F24F 11/84* (2018.01); *F24F 11/86* (2018.01); *F24F 2110/10* (2018.01); *F24F 2110/20* (2018.01); *F24F 2140/12* (2018.01); *F24F 2140/20* (2018.01); *F24F 2140/40* (2018.01)

(58) Field of Classification Search
CPC ..... F24F 1/0003; F24F 11/84
See application file for complete search history.

(56) References Cited

U.S. PATENT DOCUMENTS

| | | | | |
|---|---|---|---|---|
| 2004/0050082 | A1* | 3/2004 | So | F25B 13/00 62/204 |
| 2018/0031258 | A1* | 2/2018 | Hern | F24F 11/83 |
| 2022/0178603 | A1* | 6/2022 | Ochiai | F24F 11/38 |

* cited by examiner

*Primary Examiner* — Lionel Nouketcha
(74) *Attorney, Agent, or Firm* — Eversheds Sutherland (US) LLP

(57) ABSTRACT

A split heating, ventilation, and air conditional system may include an outdoor unit including a compressor and an outdoor metering device. An indoor unit may be fluidically coupled to the outdoor unit. A controller may be configured to control the outdoor unit and the indoor unit based on an indoor metering status of the indoor unit. The indoor metering status may include at least one of: (i) indoor metering device on, (ii) indoor metering device off, and (iii) indoor metering device absent. In embodiments, an outdoor assembly couplable to an indoor unit of a split system may include the outdoor unit and the controller. A method for controlling a split system including an indoor unit fluidically coupled to an outdoor unit may include controlling, by a controller, based on the indoor metering status of the indoor unit, the outdoor unit and the indoor unit.

20 Claims, 2 Drawing Sheets

(51) Int. Cl.
*F24F 140/20* (2018.01)
*F24F 140/40* (2018.01)

ADJUSTABLE SPLIT HEATING, VENTILATING, AND AIR CONDITIONING SYSTEMS

CROSS-REFERENCE TO RELATED APPLICATION

This application claims the benefit of U.S. Application No. 63/479,567, filed Jan. 12, 2023, the entirety of which is hereby incorporated by reference.

TECHNICAL FIELD

The present disclosure is generally in the field of heating, ventilation, and air conditioning, and more particularly related to adjustable split systems.

BACKGROUND

Split heating, ventilation, and air conditioning (HVAC) systems may include two types of units, indoor units and outdoor units. An indoor unit is an air handler deployed indoors within a space to be heated or cooled, while an outdoor unit includes an air-conditioner or heat pump located in an ambient environment, external to the space. The indoor unit is in fluid communication with the outdoor unit. In a heat-pump mode, heat is extracted from the outdoor ambient environment, and transferred from the outdoor unit to the indoor unit, to heat the indoor space. In an air-conditioning mode, heat is extracted from the indoor space by the air handler and transferred to the outdoor unit to be dissipated into the external ambient environment.

SUMMARY

The present disclosure describes adjustable split HVAC systems, for example, systems in which an outdoor unit including an outdoor metering device may be controlled in response to an indoor metering status.

In embodiments, the present disclosure describes a split HVAC system. The system may include an outdoor unit including a compressor and an outdoor metering device. The system may further include an indoor unit fluidically coupled to the outdoor unit. The system may further include a controller configured to control the outdoor unit and the indoor unit based on an indoor metering status of the indoor unit. The indoor metering status includes at least one of: (i) indoor metering device on, (ii) indoor metering device off, and (iii) indoor metering device absent.

In embodiments, the present disclosure describes an outdoor assembly couplable to an indoor unit of a split HVAC system. The outdoor assembly may include an outdoor unit including a compressor and an outdoor metering device. The outdoor assembly may further include a controller configured to control the outdoor unit and the indoor unit based on an indoor metering status of the indoor unit. The indoor metering status includes at least one of: (i) indoor metering device on, (ii) indoor metering device off, and (iii) indoor metering device absent.

In embodiments, the present disclosure describes a method for controlling a split HVAC system including an indoor unit fluidically coupled to an outdoor unit. The method may include controlling, by a controller, based on an indoor metering status of the indoor unit, the outdoor unit. The method may further include controlling, by the controller, based on the indoor metering status of the indoor unit, the indoor unit. The indoor metering status may include at least one of: (i) indoor metering device on, (ii) indoor metering device off, and (iii) indoor metering device absent.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

The present disclosure provides a more detailed and specific description with reference to the accompanying drawings. The drawings and specific descriptions of the drawings, as well as any specific or other embodiments discussed, are intended to be read in conjunction with the entirety of this disclosure.

DETAILED DESCRIPTION

Example embodiments will now be described more fully hereinafter with reference to the accompanying drawings, in which example embodiments are shown. The concepts disclosed herein may however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical elements throughout.

The present disclosure describes split air-conditioning and/or heat-pump systems (also known as outdoor units) with variable-capacity capabilities and/or control of a refrigerant metering device. Such systems may be installed with a pre-existing air handler or furnace (also known as indoor unit) such that the homeowner only needs to replace the outdoor unit without replacing the indoor unit at the same time. Such partial replacement is more cost-effective then replacing both the indoor and outdoor units. Systems according to the present disclosure may also be useful with air-moving devices that do not include a refrigerant metering device, or where the refrigerant metering device has been removed. The refrigerant metering device may include a Thermal Expansion Valve (TXV), an Electronic Expansion Valve (EXV), fixed orifices, (such as flow check pistons) or any other type of device used to control, reduce, slow or stop the flow of refrigerant. The outdoor unit may be versatile and work with different types of refrigerant, indoor expansion valve, capacity or other relevant system parameters.

Figure 1:
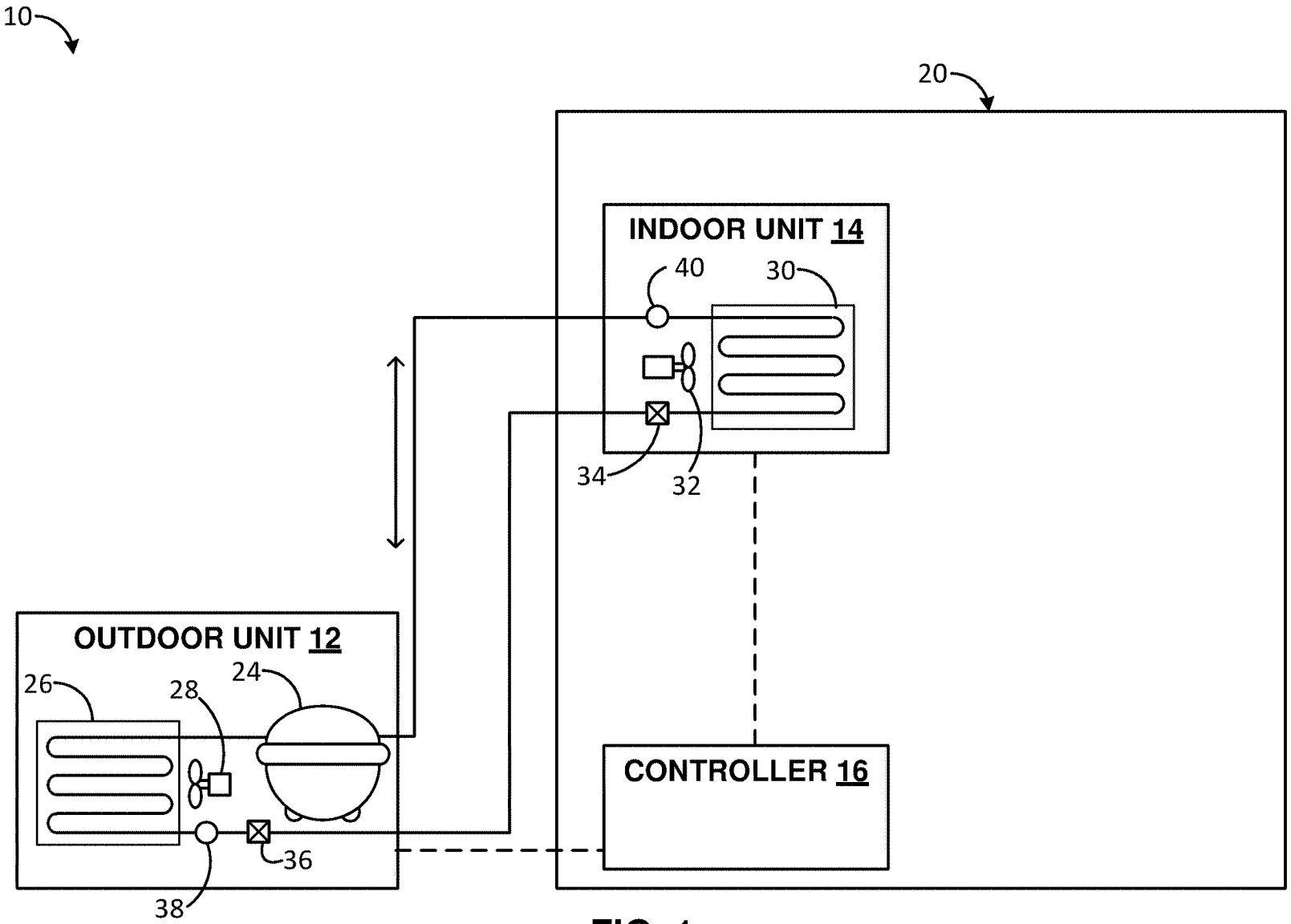
FIG. 1 is a schematic diagram showing a split HVAC system including an outdoor unit, an indoor unit, and a controller, for heating or cooling a space.

FIG. 1 is a schematic diagram showing a split HVAC system 10 including an outdoor unit 12, an indoor unit 14, and a controller 16, for heating or cooling a space 20. The indoor unit 14 is fluidically coupled to the outdoor unit 12. The controller 16 is configured to control one or both of the outdoor unit 12 or the indoor unit 14 based on an indoor metering status. For example, the system 10 may constitute an adjustable split system by controlling the outdoor unit 12 or the indoor unit 14 based on whether an indoor metering device of the indoor unit 14 is on or off, or whether an indoor metering device is absent from indoor unit 14.

To provide heating and cooling even when an indoor metering unit is absent, defective, operating at diminished capacity, or off, the outdoor unit 12 may include an outdoor metering device 36. The outdoor unit 12 may further include a compressor 24 for operating a cooling or heating operation or cycle. For example, the compressor 24 may compress a volume of refrigerant flowing between the outdoor unit 12 and the indoor unit 14 to ultimately cause heat to be transferred either from an exterior ambient environment to the space 20 (to heat the space 20), or from the space 20 to the exterior ambient environment (to cool the space 20).

For example, the outdoor unit 12 may include an outdoor coil 26 and an outdoor fan 28. In a cooling mode, the compressor 24 may draw refrigerant from the indoor unit 14, and compress the refrigerant, resulting in heating of the refrigerant. The heated refrigerant may flow through the outdoor coil 26 to dissipate heat from the outdoor coil 26 to the ambient environment, resulting in cooling of the refrigerant, and thus ultimately dissipating heat transferred from the space 20 via the indoor unit 14 to the outdoor unit 12 into the environment. The outdoor fan 28 may force or blow air across the outdoor coil 26 to facilitate heat transfer.

Likewise, the indoor unit 14 may include an indoor coil 30 and an indoor fan 32. In the cooling mode, partially cooled refrigerant from the outdoor unit 14 may flow through the indoor coil 30, with the indoor fan 32 facilitating heat transfer to continue the cooling cycle.

The indoor unit 14 may optionally include an indoor metering device 34. The indoor metering device 34 may meter (control the flow and/or pressure of) refrigerant flowing through the indoor coil 30, and ultimately, between the outdoor unit 12 and the indoor unit 14.

An indoor metering device may be absent from the indoor unit 14. When the indoor metering device 34 is present, the indoor metering device may have different operational statuses, for example, on, off, damaged, defective, diminished capacity, or other statuses. Accordingly, an indoor metering status may generally include at least one of: (i) indoor metering device on, (ii) indoor metering device off, and (iii) indoor metering device absent.

In embodiments, the indoor metering is associated with an indoor expansion valve. For example, the indoor metering device 34 may include an indoor expansion valve, or be expected to include an indoor expansion valve. In such embodiments, the indoor metering status may include at least one of: (i) indoor expansion valve on, (ii) indoor expansion valve off, and (iii) indoor expansion valve absent. In some such embodiments, the indoor expansion valve is a thermal expansion valve or an electronic expansion valve. The expansion valve facilitates expansion of refrigerant into the indoor coil 30, which further induces cooling of the refrigerant, further facilitating heat transfer. The expanded (reduced pressure) refrigerant exiting the indoor coil 30 now returns to the compressor 24 for compression, continuing the cooling cycle.

The outdoor unit 12 includes the outdoor metering device 36. The outdoor metering device 36 may include an outdoor expansion valve. In embodiments, the outdoor expansion valve is a thermal expansion valve or an electronic expansion valve.

The outdoor metering device 36 may be operated in conjunction with the indoor metering device 34 (when present), or to compensate for the lack of an operational indoor metering device 34 (when absent, off, incapacitated, damaged, removed for maintenance, or for some other reason). For example, if an indoor metering device 34 is absent or operating in a diminished capacity, the outdoor metering device 36 may replace or augment the expansion (or metering) of refrigerant that would have otherwise been provided solely by the indoor metering unit 34.

The outdoor metering device 36 may also account for, or facilitate adjustment, or otherwise augment the operation of the indoor metering device 34, based on a number of other parameters. For example, if the indoor unit 14 is designed for use with a particular refrigerant having certain operating characteristics, another refrigerant may be used in the system, with the outdoor metering device 36 assisting with changing the flow, pressure, or expansion (or generally, metering) of the replacement refrigerant to compensate for the changed refrigerant characteristics, which may thus allow the indoor unit 14 to operate with a different refrigerant than initially designed for.

In a heating mode (heat pump mode), the outdoor unit 12 may extract heat from the ambient environment by absorbing heat in a refrigerant stream cooled below the ambient temperature, and then passing that heated refrigerant to the indoor unit 14, which then dissipates heat into the space 20.

The controller 16 is configured to control the outdoor unit 12 and the indoor unit 14 based on the indoor metering status of the indoor unit 14. The operation of the controller 16 is further described with reference to FIG. 2.

Figure 2:
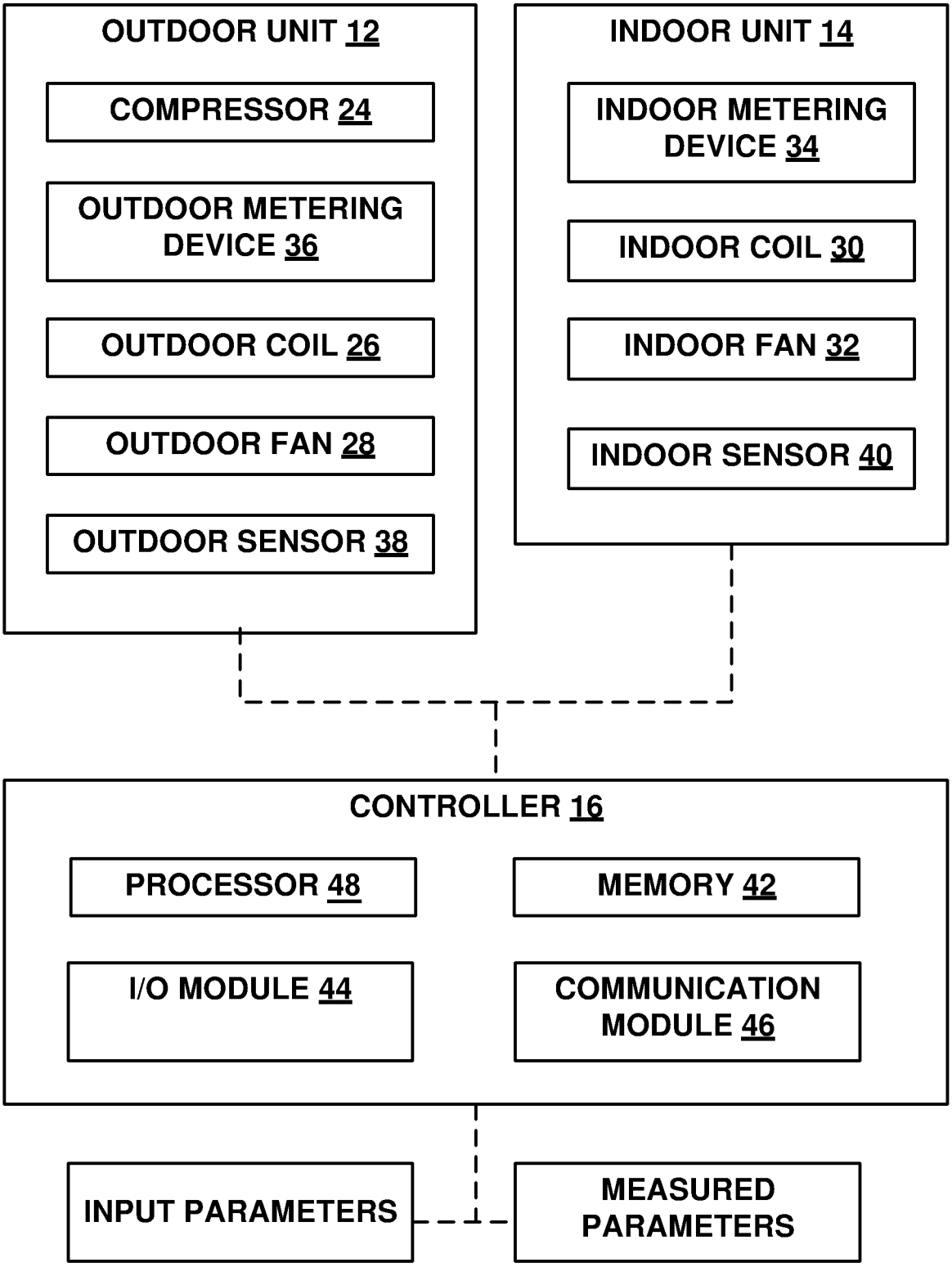
FIG. 2 is a block diagram showing the system of FIG. 1.

FIG. 2 is a block diagram showing the system 10 of FIG. 1. The controller 16 may be housed in a housing. The controller 16 may be a static device fixedly or removably mounted to a surface, for example, a wall or another internal surface in space 20. In embodiments, the controller 16 may be a computing device, for example, a personal computer, a desktop, a tablet, a laptop, a cellphone, a cloud-connected device, a handheld device, or some other computing device. In some embodiments, the controller 16 may be a dedicated device. In some embodiments, the controller 16 may be implemented in a thermostat unit. As seen in FIG. 2, the controller 16 may include one or more processors 48 and a memory 42. The processor 48 may be configured to execute instructions stored on the memory 42, for example, to implement a method or a process. The memory may include a non-transitory storage medium.

The controller 16 may further include an input/output (I/O) module 44. The I/O module 44 may include circuitry for receiving and sending signals indicative of data or instructions. The I/O module 44 may include a transceiver for wireless communications and a bus for wired communications.

The controller 16 may further include a communication module 46. The communication module 46 may interface components within the controller 16, or components external to the controller 16. For example, the controller 16 may send control signals or receive signals to or from an internal or external component via the communication module 46. The communication module 46 may be configured to provide wireless or wired communication. In embodiments, the controller 16 may not include a separate communication module 46, and the I/O module may perform functions described with reference to the communication module 46.

In embodiments, the controller 16 is configured to control an indoor valve position of the indoor expansion valve (of the indoor metering device 34) based on the indoor metering status. Likewise, the controller 16 may be configured to control the compressor 24 and the outdoor metering device 36 based on the indoor metering status. For example, the controller 16 may be configured to control an outdoor valve position of the outdoor expansion valve (of the outdoor metering device 36) based on the indoor metering status. The controller 16 may be configured to control a speed of the compressor 24 based on the indoor metering status. Thus, the controller 16 may control the outdoor unit 12 by controlling one or more components or devices of the outdoor unit 12.

The controller 16 may send control signals to one or more components, such as to the compressor 24, the outdoor fan 28, the indoor fan 32, the indoor metering device 34, or the outdoor metering device 36. The controller 16 may also receive feedback signals from these or other components or devices, for example, feedback indicating the status of the respective components or devices, such as a valve position, compressor speed, fan speed, or other operational parameters.

In embodiments, a user, manufacturer, or technician may provide control parameters to the controller 16, and the controller 16 may operate the system 10 in accordance with one or more control parameters. For example, controller 16 may be configured to control the outdoor unit 12 and the indoor unit 14 based on at least one input parameter. The at least one input parameter may be received via the I/O module 44. For example, input may be provided to the controller 16 using a keypad, pushbuttons, Bluetooth, Wi-fi or any other type of interface which allows a user to select one or more parameters.

In embodiments, the system 10 may include a control panel. For example, the controller 16 or some other component may be provided with a control panel. The control panel may include an input and an output, for example, a keyboard, a set of buttons, a display, a touchscreen, or any other suitable inputs or outputs. The at least one input parameter may include one or more of (i) a refrigerant type, (ii) an indoor metering device type, (iii) an indoor target superheat, (iv) an indoor unit capacity, (v) a lineset size, (vi) a number of stages, and (vii) a modulation ability. The refrigerant type may include R-22, R-410A, or other refrigerants. Thus, the controller 16 may account for one or more predetermined parameters. In embodiments, the input parameter may itself include the indoor metering status. For example, a user or installer may input a parameter indicating that no indoor metering device is installed, or that the indoor metering device has been removed from the indoor unit 14, to cause the controller 16 to control the outdoor unit 12 to handle refrigerant metering in both cooling and heat-pump heating modes. Thus, a field selection may be made at the controller 16 to specify that the indoor unit 14 does not have a metering device and allow for the outdoor unit 12 to perform refrigerant metering as needed.

The system 10 may include one or more sensors, and the controller 16 may receive signals from one or more sensors indicating measured parameters. For example, the system 10 may include at least one outdoor sensor 38 (for example, in the outdoor unit 12), or at least one indoor sensor 40 (for example, in the indoor unit 14), or both, or none. In some embodiments, the sensor 40 may be disposed at the outdoor unit. The space 20 may also include one or more sensors. Additionally, there may be one or more external sensors outside the outdoor unit 12. One or more of these sensors may measure air temperature, air pressure, air humidity, refrigerant temperature, refrigerant pressure, refrigerant flow rate, fan speed, or any other suitable parameter. In embodiments, the controller 16 is configured to control the outdoor unit 12 and the indoor unit 14 based on at least one measured parameter. The at least one measured parameter may be received from one or more sensors. The at least one measured parameter may include one or more of (i) a rotation speed of an indoor fan of the indoor unit, (ii) an indoor unit flow velocity, (iii) an indoor unit expected capacity, (iv) a supply air temperature, (v) a return air temperature, (vi) an evaporator coil temperature, (vii) an indoor metering device position, (viii) an outdoor metering device position, (ix) an indoor coil refrigerant pressure, (x) an indoor coil refrigerant temperature, (xi) an interior temperature, (xii) an interior relative humidity, (xiii) a thermostat mode, (xiv) a thermostat setpoint, and (xv) a demand status for heat-pump heating or cooling operation.

The measured parameter may be transmitted to the controller 16 via a wired connection or wireless connection (for example, via Bluetooth, Wi-Fi or any other wireless means). The data may be collected and stored on a computer or cell phone (or other electronic device) with or without the aid of a special software application designed to collect, store and transmit the data back to the outdoor unit for modification of operation to enhance performance based on system conditions. The collected data could also be transmitted offsite for transmission later via (for example) internet or other means to similarly enhance the performance of the outdoor unit at a later time.

In addition to input parameters or measured parameters, the controller 16 may also be responsive to different modes of operation. For example, the controller 16 may be configured to operate the indoor unit 14 and the outdoor unit 12 in response to a user-set operation mode including (i) an efficiency mode, or (ii) a performance mode. Other operation modes (for example, balanced) may also be used. In embodiments, an installer, user, or another operator may select performance parameters manually to be adjusted-either individually or as a group of parameters, to enhance or improve performance as desired. The performance mode may result in relatively rapid heating or cooling, but with a higher energy expenditure. In contrast, the efficiency mode may result in a lower energy expenditure with greater time required to achieve a temperature setpoint in space 20.

While the controller 16 may be located within space 20 as shown in FIG. 1, the controller 16 may instead be located outside space 20, or even remote from space 20. In embodiments, an outdoor assembly couplable to an indoor unit 14 of a split system 10 may include the outdoor unit 12 and the controller 16. In embodiments, the controller 16 may be housed in or secured to a housing of the outdoor unit 16.

Thus, the outdoor assembly may constitute a "universal" or "general" outdoor unit usable with one or more types of indoor units. For example, the type of the indoor unit may be changed, or upgraded, and the outdoor assembly (or the outdoor unit 12 and the controller 16) may adjust or compensate for the change in the indoor unit. In some embodiments, the outdoor assembly may be provided by a manufacturer, and an end user or installer may configure the outdoor assembly (for example, by using input parameters), or the controller 16 may configure itself (for example, by using measured parameters), based on the type and number of indoor units that are coupled to the outdoor assembly, or based on other aspects such as orientation or layout of the space 20, or the location of the indoor units in space 20. The controller 16 (or ultimately, the outdoor assembly) may be configured to, in response to a presence of an indoor metering device 34 of the indoor unit 14, control the indoor metering device 14.

The controller 16 may be in communication with the indoor unit 14, for example, by a wired or wireless connection, the controller 16 may operate the outdoor unit 12 to control refrigerant flow while accounting for the indoor metering status. For example, the controller 16 may be configured to set the valve position of the indoor expansion valve (of the indoor metering device 34) to a fixed open position, and meter refrigerant through the system by controlling the outdoor metering device 36. The fixed open position may be a partially open position, or a fully open position. Thus, the controller 16 may bypass the indoor metering device 34 by fully opening the indoor metering device 34.

Thus, the system 10 may provide metering of refrigerant via an outdoor metering device that may compensate for or augment a missing, removed, defective, diminished, or inoperative indoor metering device. The assembly of the outdoor unit and the controller may provide a general or universal outdoor assembly usable with a variety of different types of indoor units.

In embodiments, the present disclosure describes a method for controlling a split HVAC system including an indoor unit fluidically coupled to an outdoor unit. The method may include controlling, by a controller, based on an indoor metering status of the indoor unit, the outdoor unit. The method may further include controlling, by the controller, based on the indoor metering status of the indoor unit, the indoor unit. The indoor metering status may include at least one of: (i) indoor metering device on, (ii) indoor metering device off, and (iii) indoor metering device absent.

In embodiments, the indoor metering is associated with an indoor expansion valve, and the indoor metering status may include at least one of: (i) indoor expansion valve on, (ii) indoor expansion valve off, and (iii) indoor expansion valve absent.

In embodiments, the method may further include controlling, by the controller, an indoor valve position of the indoor expansion valve based on the indoor metering status.

In embodiments, the method may further include setting, by the controller, the indoor valve position of the indoor expansion valve to a fixed open position. In embodiments, the method may further include metering, by the controller, refrigerant through the system by controlling the outdoor metering device.

In embodiments, the method may further include controlling, by the controller, based on the indoor metering status, a compressor and an outdoor metering device of the outdoor unit.

In embodiments, where the outdoor metering device includes an outdoor expansion valve, the method may further include controlling, by the controller, an outdoor valve position of the outdoor expansion valve based on the indoor metering status.

In embodiments, the method may further include controlling, by the controller, a speed of the compressor based on the indoor metering status.

In embodiments, the method may further include controlling, by the controller, the outdoor unit and the indoor unit based on at least one input parameter. The at least one input parameter may include one or more of (i) a refrigerant type, (ii) an indoor metering device type, (iii) an indoor target superheat, (iv) an indoor unit capacity, (v) a lineset size, (vi) a number of stages, and (vii) a modulation ability.

In embodiments, the method may further include controlling, by the controller, the outdoor unit and the indoor unit based on at least one measured parameter. The at least one measured parameter includes one or more of (i) a rotation speed of an indoor fan of the indoor unit, (ii) an indoor unit flow velocity, (iii) an indoor unit expected capacity, (iv) a supply air temperature, (v) a return air temperature, (vi) an evaporator coil temperature, (vii) an indoor metering device position, (viii) an outdoor metering device position, (ix) an indoor coil refrigerant pressure, (x) an indoor coil refrigerant temperature, (xi) an interior temperature, (xii) an interior relative humidity, (xiii) a thermostat mode, (xiv) a thermostat setpoint, and (xv) a demand status for heat-pump heating or cooling operation.

The method may further include controlling, by the controller, the indoor unit and the outdoor unit in response to a user-set operation mode including (i) an efficiency mode, or (ii) a performance mode.

In embodiments, a systems test may be performed using functions that can be controlled by the outdoor unit to determine the capabilities of the indoor unit and other system parameters. For example, the systems test may include operating the outdoor expansion valve, compressor speed (or otherwise increase or decrease capacity) and outdoor fan motor while monitoring various variable inputs, for example (but not limited to), suction and liquid line temperatures and line pressures, coil temperature (at various locations and potential multiple locations), outdoor air temperature and so on. The systems test may include actuating a reversing valve to reverse flow of refrigerant through the system and collecting associated data.

The systems test would then collect data at various capacities and various combinations of metering, compressor speed and outdoor fan speed (or any other potential controllable system parameter—such as suction temperature) over a period of time. The collected data would then be used to determine the best system performance at any condition, any mode of operation or any level of capacity. The system operation would then be modified to achieve the best performance for efficiency, capacity or other desirable system capability.

The test mode can either be initiated manually in the field at any point after installation or automatically on start-up or manually or automatically on regular intervals as necessary for continuous data collection and system improvement or for regular calibration.

Systems, assemblies, and methods according to the present disclosure may provide one or more advantages. For example, the system may be calibrated, adjusted, or "tuned" based on particular indoor units (air moving devices) and other parameters unique to the installation site. Replacement cost may be reduced, as the existing indoor unit may be reused with only the outdoor unit being replaced. Without adjustability, the indoor unit may need to be replaced because of unacceptable performance with other or replacement outdoor units. The adjustability may also result in a higher efficiency over a system that cannot be adjusted. Further, increased heating or cooling capacity may be provided as compared to a conventional system. The reliability of the system may be improved, because operating times and capacities are adjusted. The systems may also provide improved capacity matching to system load. For example, the present adjustable systems may be more closely matched to the system load. The adjustable systems may operate more frequently at reduced system capacity in comparison with a conventional system. Thus, noise levels may also be reduced for longer periods of time. The present systems may provide improvements in humidity control because adjustability may improve sensible and latent heat removal accuracy.

The present systems also may result in a lower replacement cost when changing refrigerants (outdoor unit only). It is possible that an adjustable outdoor unit/assembly can be adjusted to a specific refrigerant, which is not the native refrigerant for which the outdoor unit was originally designed. For example, the outdoor unit could be tuned to the refrigerant of the indoor unit. Likewise, the outdoor unit/assembly may be adjusted to compensate and adjust the system in a way that the native refrigerant of the pre-existing indoor unit could be changed to the new refrigerant (native to the outdoor unit) without replacing the indoor unit.

Providing adjustable controllers and outdoor units may reduce the number of stock-keeping units (SKU's) provided by the manufacturer to cover various types of replacement scenarios where the outdoor unit is replaced and the indoor unit is not. This may also advantageously reduce the number of SKU's stocked by the distributor.

Modifications and variations of the assemblies, devices, and methods described herein will be obvious to those skilled in the art from the foregoing detailed description. Such modifications and variations are intended to come within the scope of the appended claims.

What is claimed is:

1. A split heating, ventilation, and air conditioning (HVAC) system comprising:

an outdoor unit comprising a compressor and an outdoor metering device;

an indoor unit fluidically coupled to the outdoor unit; and a controller configured to adapt control of the outdoor unit and the indoor unit based on an indoor metering status of the indoor unit, wherein the indoor metering status comprises at least one of: (i) indoor metering device on, (ii) indoor metering device off, or (iii) indoor metering device absent.

2. The system of claim 1, wherein the indoor metering status is associated with an indoor expansion valve, and wherein the indoor metering status comprises at least one of: (i) indoor expansion valve on, (ii) indoor expansion valve off, or (iii) indoor expansion valve absent.

3. The system of claim 2, wherein the indoor expansion valve is a thermal expansion valve or an electronic expansion valve.

4. The system of claim 2, wherein the controller is configured to control an indoor valve position of the indoor expansion valve based on the indoor metering status.

5. The system of claim 1, wherein the controller is configured to control the compressor and the outdoor metering device based on the indoor metering status.

6. The system of claim 1, wherein the outdoor metering device comprises an outdoor expansion valve.

7. The system of claim 6, wherein the outdoor expansion valve is a thermal expansion valve or an electronic expansion valve.

8. The system of claim 7, wherein the controller is configured to control an outdoor valve position of the outdoor expansion valve based on the indoor metering status.

9. The system of claim 1, wherein the controller is configured to control a speed of the compressor based on the indoor metering status.

10. The system of claim 1, wherein the controller is configured to operate the indoor unit and the outdoor unit in response to a user-set operation mode comprising (i) an efficiency mode, or (ii) a performance mode.

11. The system of claim 1, wherein the outdoor unit comprises the controller, and wherein the controller is configured to, in response to a presence of an indoor metering device of the indoor unit, control the indoor metering device via the controller.

12. The system of claim 11, wherein the indoor metering device comprises an indoor expansion valve, and wherein the controller is configured to control an indoor valve position of the indoor expansion valve.

13. An outdoor assembly configured to be coupled to an indoor unit of a split heating, ventilation, and air conditioning (HVAC) system, the outdoor assembly comprising:

an outdoor unit comprising a compressor and an outdoor metering device; and a controller configured to control the outdoor unit and the indoor unit based on an indoor metering status of the indoor unit, wherein the indoor metering status comprises at least one of: (i) indoor metering device on, (ii) indoor metering device off, or (iii) indoor metering device absent; and wherein the controller is configured to control the outdoor metering device in a first control mode in response to the indoor metering status indicating the indoor metering device is on, and control the outdoor metering device in a second control mode different from the first control mode in response to the indoor metering status indicating the indoor metering device is off or absent.

14. The assembly of claim 13, wherein the controller is configured to control the compressor and the outdoor metering device based on the indoor metering status.

15. The assembly of claim 14, wherein the outdoor metering device comprises an outdoor expansion valve, wherein the controller is configured to control an outdoor valve position of the outdoor expansion valve based on the indoor metering status, and wherein the controller is configured to control a speed of the compressor based on the indoor metering status.

16. The assembly of claim 13, wherein the indoor unit comprises an indoor expansion valve, and wherein the controller is configured to control an indoor valve position of the indoor expansion valve.

17. The assembly of claim 13, wherein the controller is configured to set the valve position of the indoor expansion valve to a fixed open position, and wherein the controller is further configured to meter refrigerant through the system by controlling the outdoor metering device.

18. The assembly of claim 17, wherein the controller is in communication with the indoor unit, and wherein the controller is configured to set the valve position of the indoor expansion valve to a fixed open position, and wherein the controller is further configured to meter refrigerant through the system by controlling the outdoor metering device.

19. The assembly of claim 13, wherein the controller is configured to control the outdoor unit and the indoor unit based on at least one measured parameter, wherein the at least one measured parameter comprises one or more of (i) a rotation speed of an indoor fan of the indoor unit, (ii) an indoor unit flow velocity, (iii) an indoor unit expected capacity, (iv) a supply air temperature, (v) a return air temperature, (vi) an evaporator coil temperature, (vii) an indoor metering device position, (viii) an outdoor metering device position, (ix) an indoor coil refrigerant pressure, (x) an indoor coil refrigerant temperature, (xi) an interior temperature, (xii) an interior relative humidity, (xiii) a thermostat mode, (xiv) a thermostat setpoint, or (xv) a demand status for heat-pump heating or cooling operation.

20. The assembly of claim 13, wherein the controller is configured to control the outdoor unit and the indoor unit based on at least one input parameter, wherein the at least one input parameter comprises one or more of (i) a refrigerant type, (ii) an indoor metering device type, (iii) an indoor target superheat, (iv) an indoor unit capacity, (v) a lineset size, (vi) a number of stages, or (vii) a modulation ability.

* * * * *